US012642335B2

(12) United States Patent
Lin et al.

(10) Patent No.: US 12,642,335 B2
(45) Date of Patent: Jun. 2, 2026

(54) ADHESIVE BONDING METHOD FOR THE SHOE MAKING

(71) Applicant: LAYA CHEMICAL ENGINEERING CO., LTD., Douliu City (TW)

(72) Inventors: Wen-Chih Lin, Douliu City (TW); Li-Yung Hsu, Taichung City (TW)

(73) Assignee: LAYA TECHNOLOGY CO., LTD., Douliu City (TW)

( * ) Notice: Subject to any disclaimer, the term of this patent is extended or adjusted under 35 U.S.C. 154(b) by 76 days.

(21) Appl. No.: 18/653,230

(22) Filed: May 2, 2024

(65) Prior Publication Data

US 2025/0338922 A1 Nov. 6, 2025

(51) Int. Cl.
*A43D 25/20* (2006.01)

(52) U.S. Cl.
CPC ..... *A43D 25/20* (2013.01)

(58) Field of Classification Search
CPC ..... A43D 25/20; A43D 25/047; B29C 65/36; B29C 65/3604; B29C 65/3608; B29C 65/3612; B29C 65/3616; B29C 65/3668; B29C 65/3672; B29C 65/3676; B29C 65/368; B29C 65/3684; B29C 65/3696; B29C 65/484; B32B 2310/0812; B32B 2310/0818; B32B 2037/1261; A43B 9/12
USPC ..... 156/272.4; 12/142 F, 142 T
See application file for complete search history.

(56) References Cited

U.S. PATENT DOCUMENTS 6,136,136 A * 10/2000 Heider ..... C08L 25/00 528/85
2021/0339481 A1* 11/2021 Sweeney ..... B29C 65/3616

FOREIGN PATENT DOCUMENTS

| | | |
|---|---|---|
| TW | 456191 U | 11/2000 |
| TW | 459563 U | 11/2000 |
| TW | 463583 U | 11/2000 |

* cited by examiner

*Primary Examiner* — John L Goff, II
(74) *Attorney, Agent, or Firm* — BACON & THOMAS, PLLC

(57) ABSTRACT

An adhesive bonding method for the shoe making, which includes the following continuous operations: heating an electromagnetic polarized solid adhesive to melt it into glue; using a glue spraying device spray a thin layer of the melted adhesive glue to the surface of the shoe outsole; put a vamp (the bottom already includes the shoe midsole) onto the shoe outsole; fix the shoe vamp and the shoe outsole with a jig fixture; put the shoe vamp and shoe outsole together with the jig into an electromagnetic polarization device; and the effect of polarization is to eliminate the crystallization caused by the hydrogen bonds in the adhesive polymer, thereby forming a tight and firm bond between the vamp and the shoe outsole; when the shoe is taken out, the unreacted isocyanide at both ends of the adhesive molecular structure formula, the acid functional group then reacts with the water molecules in the air, returns to the original crystalline molecular formula, and forms hydrogen bond cross-linking with the molecules of the outsole and midsole to achieve a tight and firm combination between the sole and the vamp.

3 Claims, 8 Drawing Sheets

ADHESIVE BONDING METHOD FOR THE SHOE MAKING

BACKGROUND OF THE INVENTION

Field of the Invention

This invention relates to an adhesive bonding method, specifically referring to an adhesive method for shoe materials in the shoe-making industry. It is an application development derivative of the U.S. patent application Ser. No. 18/521,012, which enables the adhesive bonding of shoe materials to be faster, more reliable, and pleasing. Additionally, it achieves multiple effects such as labor saving, energy saving, and space saving in the shoe adhesive bonding method.

Description of Related Art

Shoes are items used by humans to protect their feet. As shown in FIG. 1A, shoes mainly consist of two parts: the vamp (101) and the sole (102). In practice, as shown in FIG. 1B, the sole (102) exposed on the outside is also known as the outsole, and there is a midsole (103) located between the bottom of the vamp (101) and the sole (102). The vamp (101) is primarily attached to the vamp surface of the sole (102) through the midsole (103), forming the complete shoe. The vamp part (101) mainly provides a space for the foot to enter, covering the foot, and can be made from fabric, leather, or synthetic resin materials etc. The sole part (102) is mainly made from rubber material or other wear-resistant composite materials to enhance the safety, functionality, and durability of the shoe.

In ancient years, shoes were mostly made by weaving grass and vines, and only the more exquisite shoes would use needles and threads to sew the vamp and soles together. Due to the limited materials available for making shoes, there was little improvement in shoe styles for a long time. It was not until the advancement of human culture and industry that a variety of shoe materials came into existence. With the adhesives developed by the chemical industry, shoes could finally be mass-produced or made by using automated methods. Now, the styles and production volumes of shoes have developed to a level unimaginable in ancient times.

In the known making process of shoes, manual glue application was commonly used in the early day, as shown in FIG. 1C. However, applying glue by hand is labor-intensive and prone to causing defects due to glue spillage. Subsequently, with industrial development, machines were utilized for rubbing, spraying, coating, or brushing glue.

From the description of conventional gluing or glue rubbing mechanisms, it's evident to see that these systems are quite complex and require a significant investment in research and development. Moreover, the adhesive materials used need to undergo multiple baking processes in an oven to achieve stable adhesiveness. This not only extends the making process time but also affects production efficiency. This situation underlines the need for innovation in adhesive application techniques that can simplify the process, reduce costs, and enhance production efficiency without compromising the quality and durability of the final product.

As for the commonly seen shoe making production line today, it is as shown in FIG. 2, which includes preparation and preliminary operations 251, gluing operations 252, bonding operations 253, and finishing operations 254. The preparation and preliminary operations 251 include line drawing 201 (drawing the designated gluing area on the vamp surface of the shoe sole), sanding 202 (cleaning or sanding to remove any mold-release agents from the sole surface), quality control 203, applying treatment agent 204 (coating the sole surface with a surface modifier to cause a chemical reaction for better adhesion), and oven 205 (baking in an oven at temperatures not exceeding 150° C.). The gluing operations 252 include first paste 206 (applying the first layer of glue on the sole surface); oven 207 (then sending the sole into the oven for baking at temperatures not exceeding 150° C.); second paste 208 (applying a second layer of glue on the sole surface); oven 209 (then sending the sole into the oven for baking at temperatures not exceeding 150° C. again). The bonding operations 253 include attaching soles 210 (adhering the vamp to the sole), pressing soles 211 (pressing the adhered shoe vamp and sole), and oven 212 (then sending the whole shoe into the oven for baking at temperatures not exceeding 150° C.). The final finishing operations 254 include glue touch-up 213, freezer 214 (sending the whole shoe into the freezer for final shaping), and packaging 215.

However, the process of adhering the shoe sole to the vamp not only requires many operators (each step needs at least two or three operators), but also consumes a lot of energy due to the use of three ovens and a freezer; moreover, the entire production line from the first step of drawing lines to the final step of entering the freezer spans about 32 meters in total process length, thus requiring a large factory space.

Recognizing the above mentioned issues, the inventor drew on extensive experience and technical knowledge in the making of various types of footwear to research and improve upon the aforementioned deficiencies. Through continuous study, experimentation, and refinement, the inventor finally developed and designed the adhesive bonding method for shoe making presented in this invention, aiming to eliminate the shortcomings and deficiencies found in existing practices.

SUMMARY OF THE INVENTION

Thus, the present invention is objected to provide a method for adhesive bonding in shoe making, which aims to shorten the adhesive process for shoe materials (such as shoe soles and vamps) and enable rapid and stable adhesion.

According to the adhesive bonding method for shoe making provided by this invention, an electromagnetic polarized solid adhesive is used as the adhesive material. By employing electromagnetic polarization equipment, this electromagnetic polarized solid adhesive can quickly achieve a stable adhesive effect, which is a secondary objective of this invention.

According to the adhesive bonding method for shoe making of this invention, by utilizing an electromagnetic polarized solid adhesive and electromagnetic polarization equipment, a one-time adhesive operation is sufficient. This not only significantly simplifies the overall shoe making process, reducing the space needed for the factory, but also improves the adhesive effect. The shoes produced are more aesthetically pleasing and complete, which is another objective of this invention.

According to the adhesive bonding method for shoe making of this invention, when bonding the shoe vamp to the sole, an electromagnetic polarized solid adhesive is heated to 40-80° C. to melt it. Then, using spray adhesive equipment, the melted adhesive is sprayed onto the surface of the sole. After the adhesive cools and solidifies, any excess adhesive from the spraying process is removed. Next, the shoe vamp is placed on the sole, and then both are pressed and fixed with a fixture. Together with the fixture, they are put into an electromagnetic polarization device. After heating in the electromagnetic polarization device for 10-100 seconds, a tight bond between the shoe vamp and the sole is achieved, which is further objective of this invention.

To allow the honorable Examiner to obtain a further understanding and awareness of the objectives, shape, structural features, and effectiveness of this invention, examples are provided in conjunction with illustrations to detailly describe the method of this invention as follows:

BRIEF DESCRIPTION OF THE DRAWINGS

FIG. 1D is a diagram disclosed in FIG. 5 of Taiwan Patent No. 456191 for a conventional example.

FIG. 1E is a diagram disclosed in FIG. 5 of Taiwan Patent No. 459563 for a conventional example.

Figure 1B:
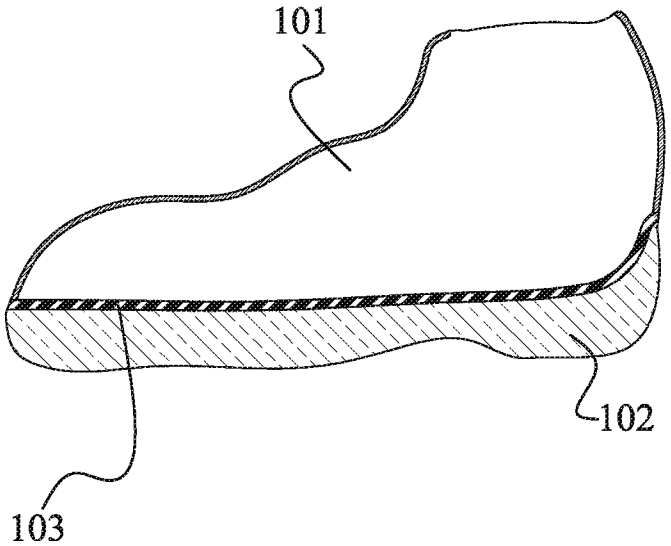
Fig. 1B (PRIOR ART)
FIG. 1B is a schematic cross-sectional diagram of a conventional shoe.
Figure 1A:
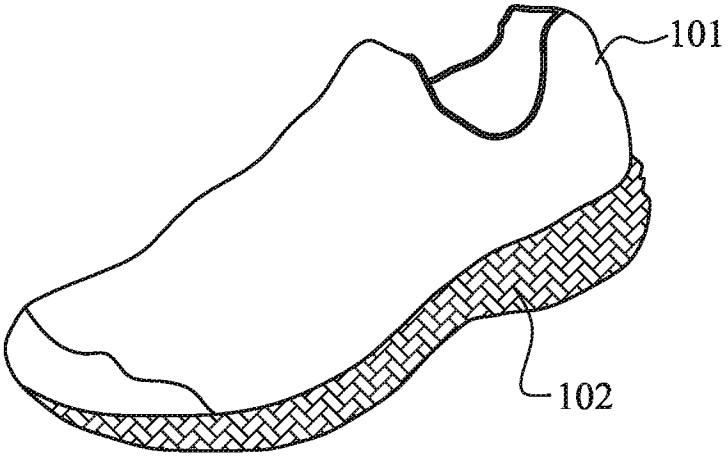
Fig. 1A (PRIOR ART)
FIG. 1A is a schematic three-dimensional diagram of a conventional shoe.
Figure 1C:
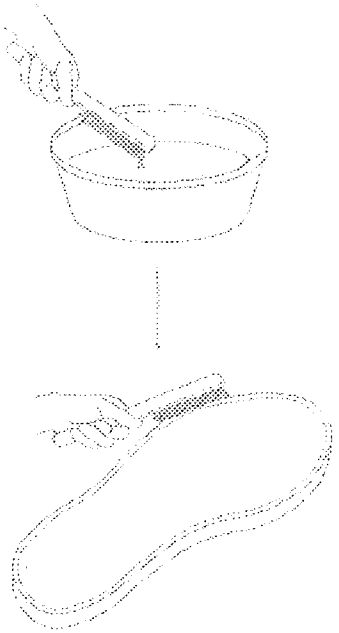
Fig. 1C (PRIOR ART)
FIG. 1C is a schematic diagram showing the manual application of glue to a conventional shoe.
Figure 2:
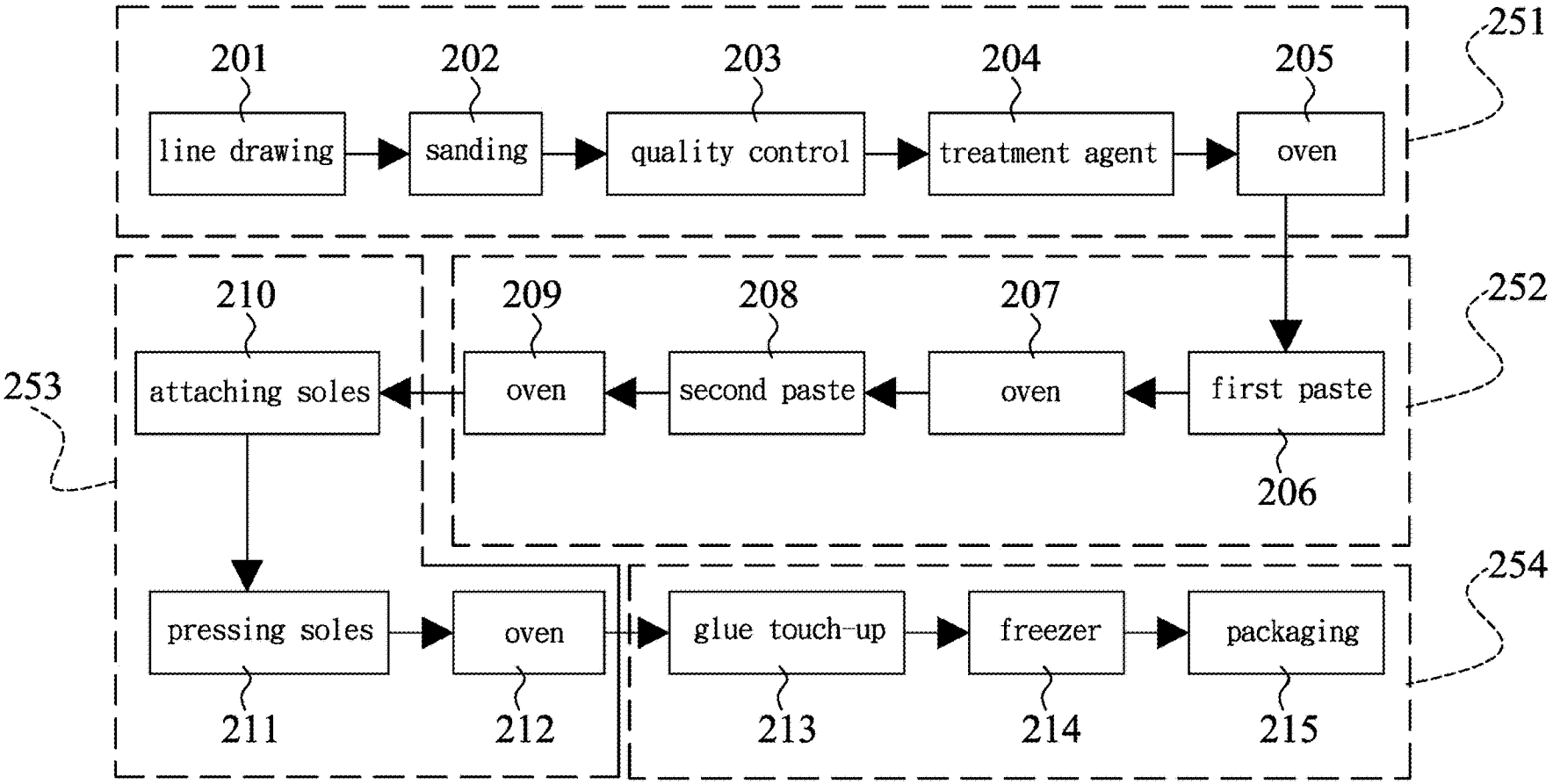
Fig. 2 (Prior art)

Figure IF is a diagram disclosed in FIG. 2 of Taiwan Patent No. 463583 for a conventional example.

FIG. 2 is a schematic diagram showing the process flow for making conventional shoes.

Figure 3:
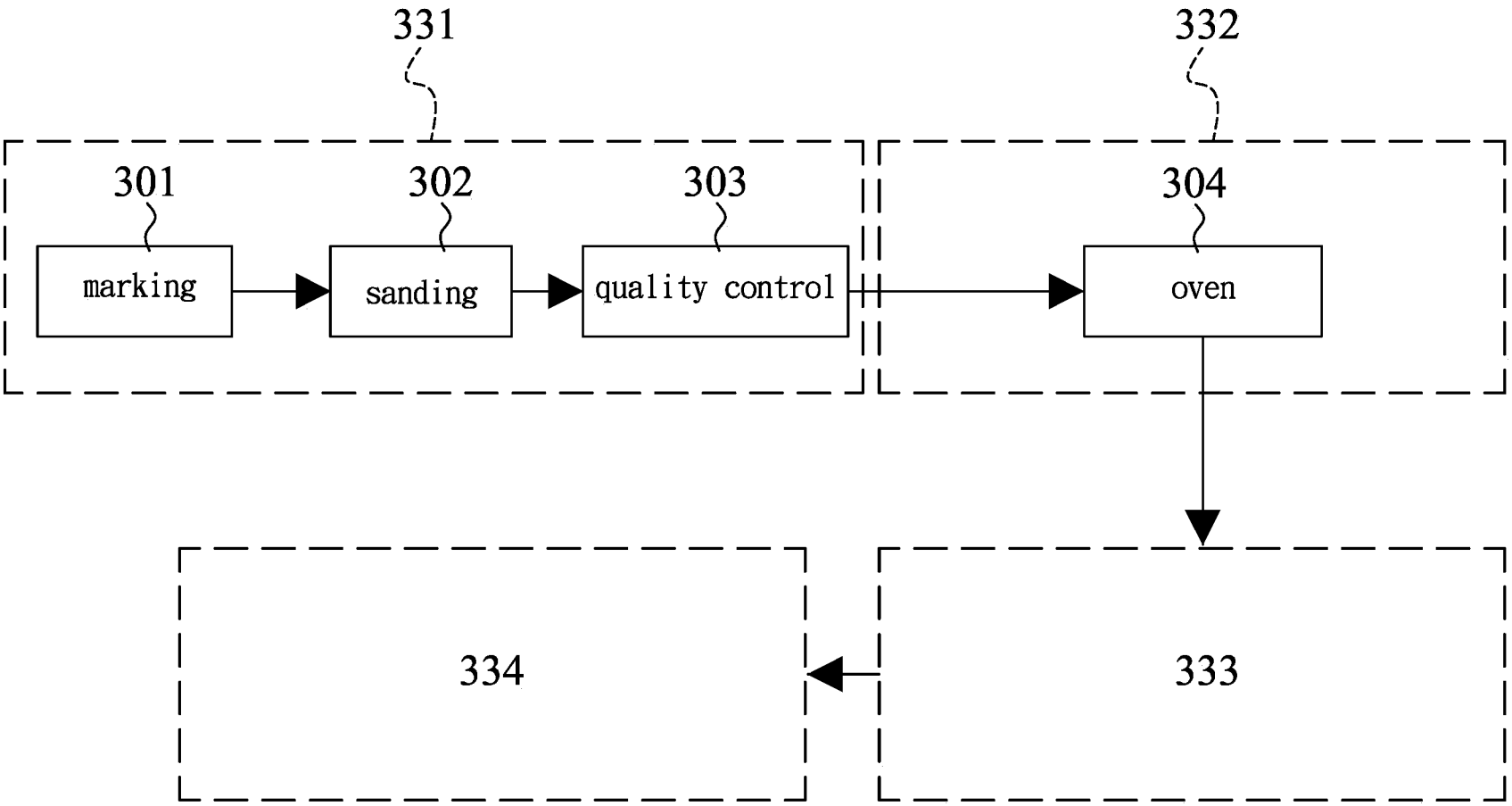

FIG. 3 is a schematic diagram showing the overview process flow of the shoe adhesive bonding method for the shoe making according to the present invention.

Figure 4A:
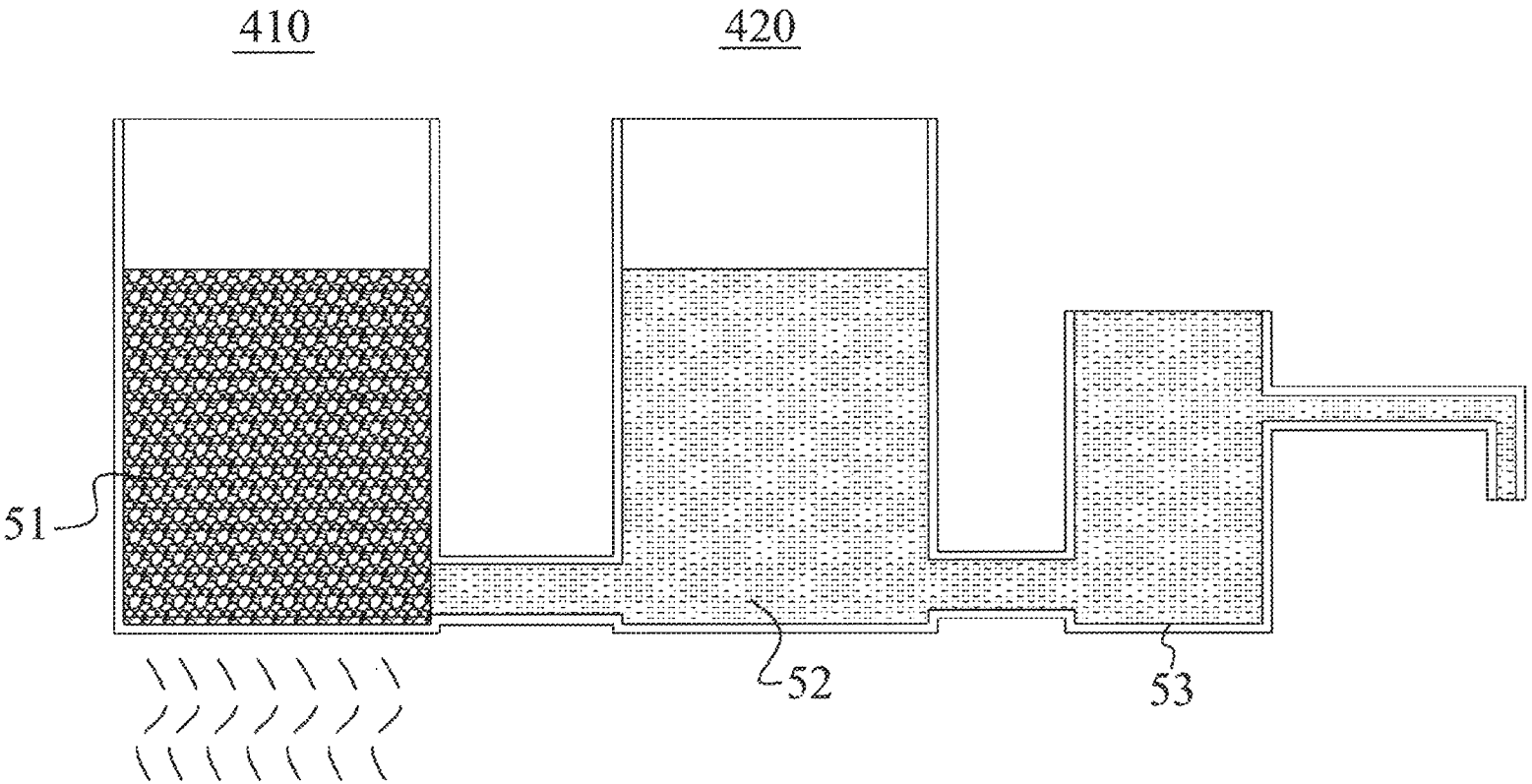

FIG. 4A shows the first process in the embodiment of the adhesive bonding method for the shoe making according to the present invention.

Figure 4B:
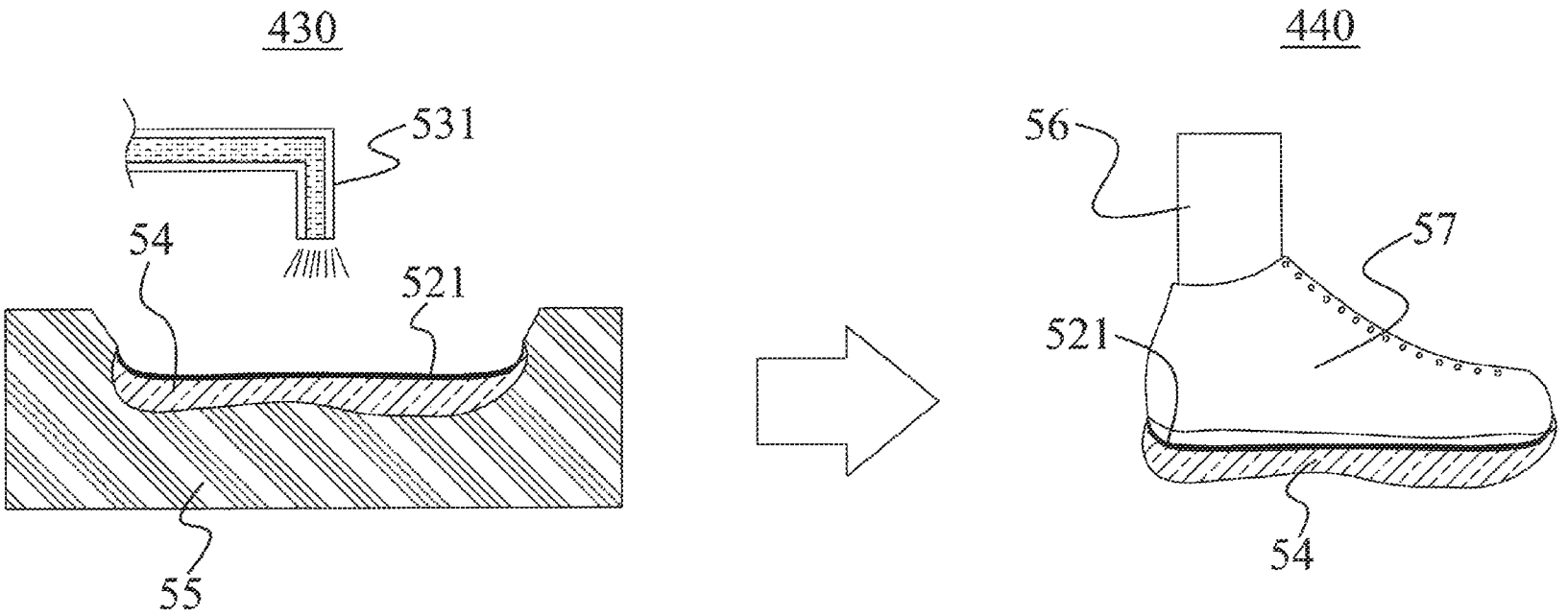

FIG. 4B shows the second process in the embodiment of the adhesive bonding method for the shoe making according to the present invention.

Figure 4C:
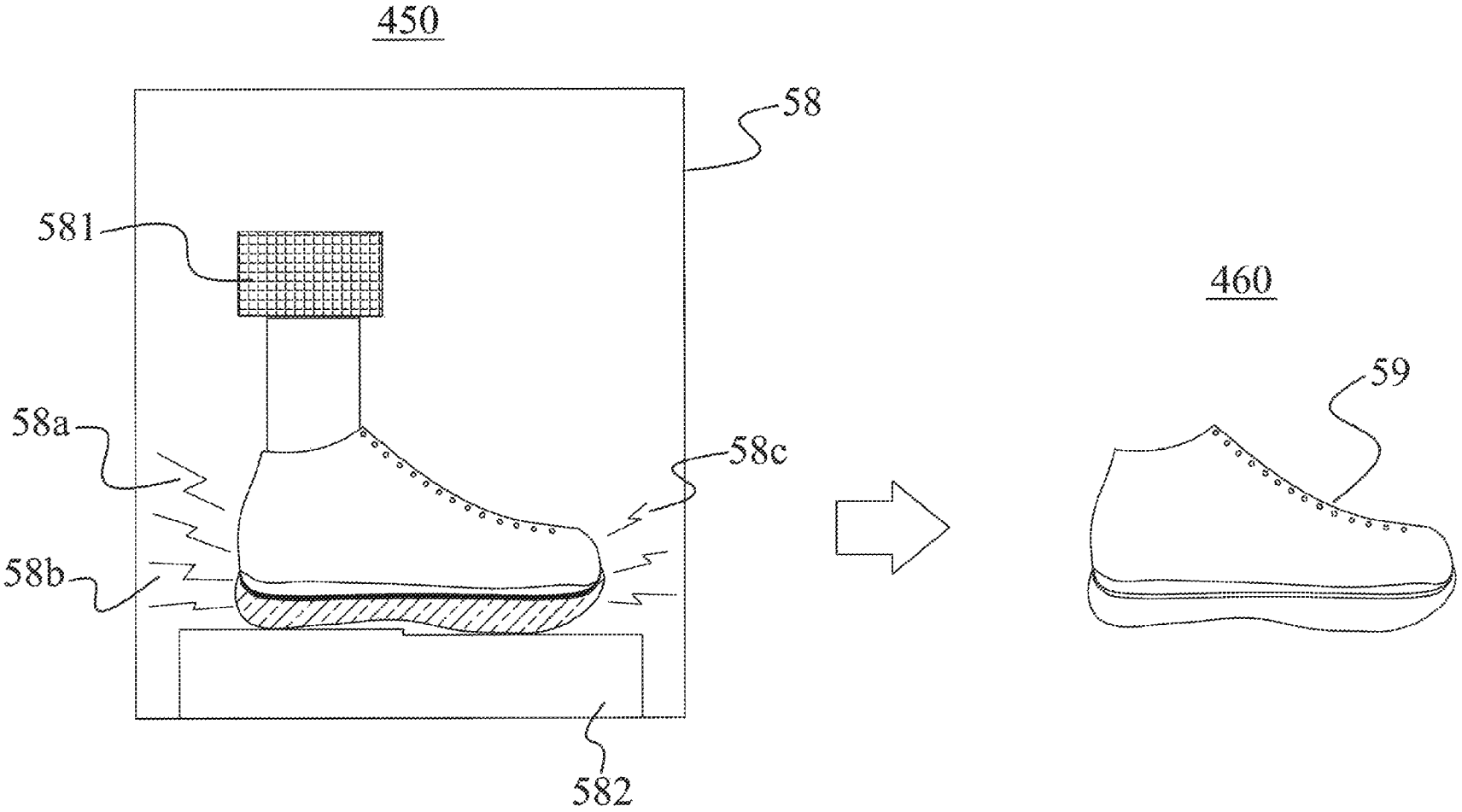

FIG. 4C shows the third process in the embodiment of the adhesive bonding method for the shoe making according to the present invention.

Figures 5A, 5B, 5C:
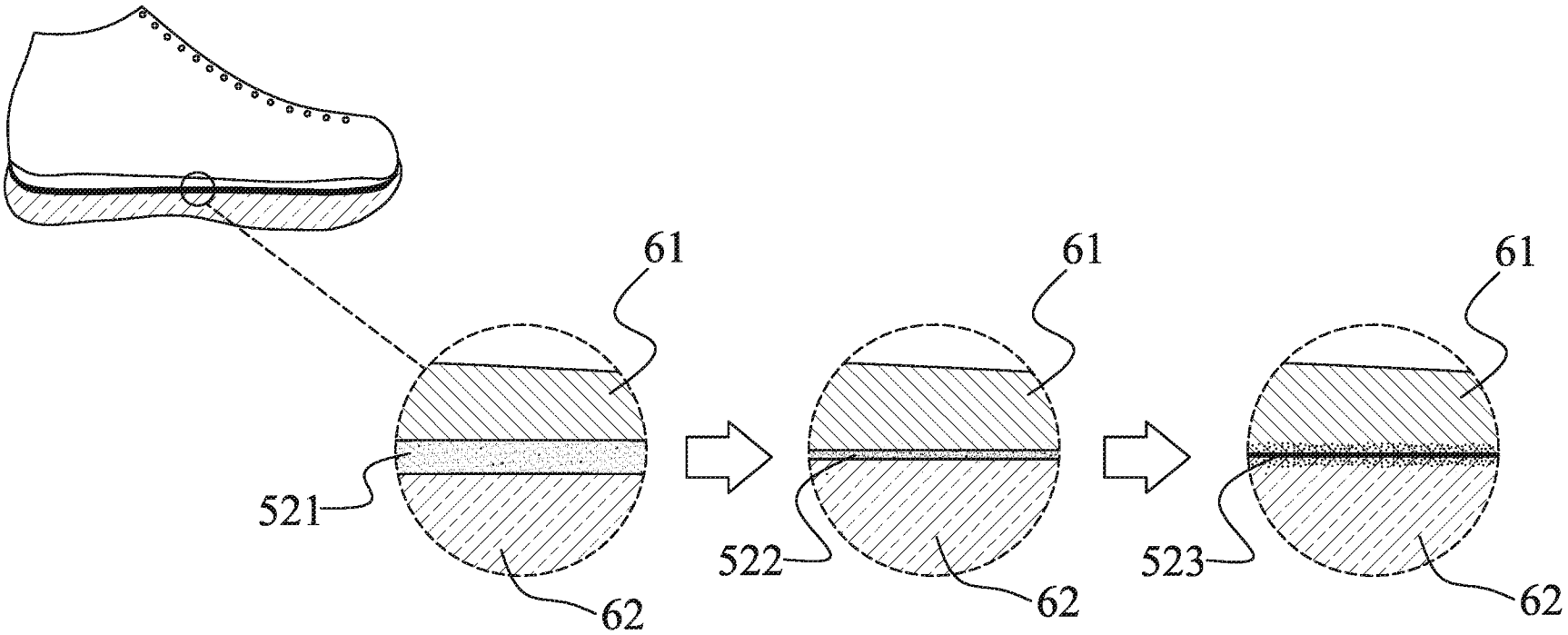

FIG. 5A-5C is respectively a schematic cross-sectional view of the adhesive in the preliminary, middle and final stage of the embodiment of the adhesive bonding method for the shoe making according to the present invention.

DETAILED DESCRIPTION OF PREFERRED EMBODIMENT

Before explaining in conjunction with the drawings, it should be clarified that this invention is not limited to the two shoe materials of the shoe vamp and the shoe sole. The reason for using the shoe vamp and the shoe sole as examples is because their bonding is the most widespread and easy to understand. The "shoe sole" mentioned in this description refers to what is commonly known as the outsole of the shoe, and the "shoe vamp" includes (or does not include) the midsole located at its bottom. For current shoes, the shoe material of the shoe vamp also includes the material of midsole.

The adhesive bonding method for the shoe making of the present invention, as shown in FIG. 3, includes preliminary work 331, pre-treatment work 332, adhesive bonding work 333, and repair work 334. Among these works, the preliminary work 331 shares similarities with conventional methods, including: marking 301 (drawing the intended glue application range on the vamp surface of the shoe sole), sanding 302 (removing the mold release agent attached to the surface of the shoe sole through cleaning or sanding), and quality control 303. The preliminary work 332 differs from conventional methods in that it does not include the step of applying a surface modifier with a treating agent on the surface of the shoe sole to induce a chemical reaction for better adhesion. Moreover, this invention does not use a high-temperature oven but rather a low-temperature oven 304 to heat the shoe sole at 40-80° C.

The adhesive bonding method for shoe making of the present invention, which bonds two different shoe materials, uses an "electromagnetic polarization solid adhesive" developed under the supervision of the applicant as the adhesive for the shoe vamp and sole. This electromagnetic polarization solid adhesive has been submitted to the authorities for U.S. patent application Ser. No. 18/521,012 filed on Nov. 28, 2023. This adhesive is an electromagnetic activation moisture reaction type solid adhesive, consisting of a formula that mixes and heats 10-95% prepolymer, 1-30% tackifier, 0.01-10% auxiliary, and 1-30% filler to 100° C.-150° C. It is then dried under a vacuum of 650-760 mmHg for 30 minutes to 4 hours to obtain a prepolymer mixture. The obtained prepolymer mixture is then cooled to below 70° C., and an electromagnetic polarization activator (EMPA) is added. It is uniformly mixed in a nitrogen atmosphere, then diisocyanate hardener is slowly added under the nitrogen atmosphere. The temperature is raised to 80-150° C. to cause the prepolymer mixture to undergo a polymerization reaction for 1.5-4 hours, and controlling the terminal isocyanate content to be 0.1-25%. A catalyst is added under the nitrogen atmosphere to accelerate the polymerization reaction. Under a vacuum of 650-760 mmHg, the nitrogen in the reaction chamber is removed, allowing the polymerization product to degas and be obtained.

Please refer to FIGS. 4A, 4B, and 4C, which illustrate the adhesive bonding operation 333 and repair operation 334 process diagrams of the shoe making adhesive bonding method of this invention, including:

(1) Heating the solid adhesive step 410: Heating the electromagnetic polarized solid adhesive 51, which is in crystalline, granular, block, flake, or strip form, at a temperature of 40-80° C.

(2) Melting and fixing the adhesive step 420: After heating, the electromagnetic polarized solid adhesive becomes a molten liquid adhesive 52, which is can be sprayed by using a glue spraying device 53.

(3) Using the glue spraying device step 430: The shoe sole 54 is pre-placed on the mold 55, and then the melted liquid adhesive 52 is sprayed onto the vamp surface of the shoe sole 54 through the nozzle 531 of the glue spraying device 53, forming a thin layer of liquid adhesive layer 521 on the vamp surface of the shoe sole 54.

(4) Assembly step 440: this step involves taking the shoe sole 54, which has been sprayed with the adhesive layer 521, off the mold 55 and removing any residual glue from the edges of the shoe sole 54. Then, the shoe sole 54 is fitted onto the shoe vamp 57 positioned over the last 56, allowing the shoe sole 54 and the shoe vamp 57 to initially adhere through the melted but still weakly adhesive liquid adhesive layer 521.

(5) Electromagnetic polarization step 450: The shoe sole 54 and the shoe vamp 57 are placed inside an electromagnetic polarization device 58, where pressing blocks 581 and clamps 582 position the shoe sole 54, shoe vamp 57, and the shoe last 56 securely. Electromagnetic waves 58*a*, 58*b*, 58*c* from the electromagnetic polarization device 58 then drive the electrostatically coated carriers within the liquid adhesive layer 521, breaking the hydrogen bonds of the hydroxyl groups within the adhesive's structure, and eliminating crystallization. This transformation causes the liquid adhesive layer 521 on the shoe sole to instantly become a gel, reaching its strongest bonding phase, thereby firmly attaching the shoe vamp 57 to the shoe sole 54 to form the shoe.

(6) Finishing and packaging step 460: After the shoe vamp 57 and shoe sole 54 are combined to form the shoe 59, it is taken out for finishing, packaging, and other processes. The unreacted isocyanate functional groups at both ends of the adhesive molecular structure then react with moisture in the air, reverting to their original crystalline molecular structure. Moreover, they form hydrogen bond cross-linking with the molecules of the shoe sole 54 and the midsole, achieving a tight and secure bond between the shoe sole and the shoe vamp.

Please refer to FIGS. 5A, 5B, and 5C, which respectively illustrate the preliminary, middle, and final-stage cross-sectional views of the liquid adhesive layer 521 in the shoe making adhesive bonding method of the present invention. FIG. 5A shows the state of the liquid adhesive after being sprayed onto the vamp surface of the shoe sole by the spray equipment, forming a thin layer of liquid adhesive 521. This liquid adhesive layer 521 is clearly separated from the shoe's midsole 61 on the vamp surface and the outsole 62 on the lower surface. FIG. 5B shows the shoe sole and vamp placed inside the electromagnetic polarization equipment, and after being magnetized by electromagnetic waves, the electrostatically charged carriers in the liquid adhesive layer 521 are moved, breaking the hydrogen bonds of hydroxyl groups in the adhesive structure, and eliminating the adhesive crystals. The liquid adhesive layer 521 instantly becomes a gel-like adhesive glue 522, which penetrates the bottom layer of the midsole 61 and the inner layer of the outsole 62. FIG. 5C illustrates the shoe after the vamp and sole have been combined and taken out, and after finishing and packaging, the unreacted isocyanate functional groups at both ends of the molecular structure of the gel-like adhesive glue 522 then react with water molecules in the air, reverting to their original crystalline molecular structure. Moreover, they form hydrogen bond cross-linking with the molecules of the outsole and midsole, becoming a hydrogen bond crystalline gel 523 with cyanide bonds in the molecular structure, thereby forming a tighter bond with the midsole 61 and the outsole 62.

The composition of the electromagnetic polarization solid adhesive used in this invention is described as follows:

The electromagnetic polarization solid adhesive used in this invention comprises a composition that includes a prepolymer, a diisocyanate hardener, a tackifier, auxiliary agents, a filler, an electromagnetically polarized active agent carrier, a resistance adjuster, a catalyst, and a coupling agent. Wherein:

Prepolymer: Includes polyester polyol, polyether polyol, polytetrmethylene ether glycol polyol, polycaprolactone polyol, polycarbonate polyol, polyhydroxyl-terminated acrylate polyol, polyhydroxyl-terminated polybutadiene, or polyhydroxyl-terminated epoxy. These prepolymers have a common feature, which is that their end groups are hydroxyl groups (—OH). Different prepolymers can be mixed to adjust the physical properties of the solid adhesive.

Diisocyanate curing agent: consists of diphenylmethane diisocyanate, toluene diisocyanate, 1,5-naphthalene diisocyanate, isophorone diisocyanate, or 4,4'-dicyclohexylmthane diisocyanate, etc.

Tackifier: consists of abietic resin, terpene resin, and hydrocarbon resin (HCR). The hydrocarbon resin (HCR) is a kind of thermoplastic resin produced by pretreatment, polymerization, distillation and other processes of C5, C6, C9 and other fractions produced by petroleum production plants. According to different raw materials, it is divided into multiple types, without a single structural formula. Preferred one types are include C5 petroleum resin, C6 petroleum resin, or C9 petroleum resin.

Auxiliaries: based on monomers, polymers, oligomers and surfactants, it has the ability to defoam, prevent precipitation, increase viscosity, improve product appearance, and improve sag resistance, color development, viscosity reduction, gloss enhancement, certainty, and balance effects (the structure of additives is confidential for each manufacturer, and no structural formula has been found). For example, it can be: a) antifoaming agent, b) leveling agent, c) anticratering agent, d) rheological agent (dilatant thickener), e) thixotropic agent (thixotropy).

Filler: also known as filler, bulking agent, refers to the improvement of work performance, product strength, etc., can be: a) Talcum powder, b) Calcium carbonate, c) Kaolin (Kaolin), etc.

Electromagnetically polarized active agent carrier: it refers to the carrier that can be used to carry electromagnetically polarized active agent in the present invention, it is preferably following powdery, granular compound: a) Quartz, b) Zirconia, c) Silicon Carbide, d) Zinc oxide, e) Calcium Oxide, f) Magnesium oxide, g) Copper oxide, h) Calcium carbonate, i) Mica, j) Iron oxide, k) Alumina, l) Carbon, m) Graphite and its isomers, n) solid polymer microspheres, o) hollow polymer microspheres (Silica Microspheres).

Resistance adjuster: it is a conductive compound and a polymer used to adjust the trace resistance on the surface of the carrier, including: poly(3,4-ethylenedioxythiophene), silver nanowire, carbon nanotube, graphene, [(Tetramethylbutyl)phenoxy]ethoxy)ethanol, or monoalkyl ether phosphate.

Catalyst: it is used to accelerate the polymerization reaction, including dibutyltin dilaurate or N, N-dimethyltrimethylenediamine.

Coupling Agent: it is an additive to improve the interfacial properties of synthetic resins and inorganic fillers or reinforcing materials in plastic compounding, also known as surface modifier, which is used in plastic processing It can reduce the viscosity of synthetic resin melt, improve the dispersion of fillers to improve processing performance, and then make the product obtain good surface quality and mechanical, thermal and electrical properties. The coupling agent generally consists of two parts, one part is an inorganic group that can interact with inorganic fillers or reinforcing materials, and the other is an organic group that can interact with synthetic resins. Including dibutyltin dilaurate, vinyltriethoxy silane, 3-isocyanatopropyl(trimethoxy)silane, (3-aminopropyl) triethoxysilane, or (3-aminopropyl) trimethoxysilane.

The electromagnetic polarization solid adhesive used in this subject invention, through the aforementioned composition, achieves adhesion by rapidly altering positive and negative electric fields to swiftly concentrate and disperse the charged structure of the electromagnetically polarized active agents. This process disrupts the hydrogen bond crystalline structure of moisture-reactive solid adhesives, causing them to liquefy for adhesion.

Therefore, the adhesive bonding method for shoe making of this invention, which utilizes the electromagnetic polarization solid adhesive in conjunction with electromagnetic polarization equipment, not only strengthens the bonding effect between the shoe vamp and sole but also offers significant advantages in terms of production equipment. Specifically, it features labor savings (a 60% reduction in labor), energy savings (an 85% reduction in energy consumption per hour, saving on ovens, vacuum pumps, and refrigeration units, with a 187 KW energy saving), and space savings (a 32% reduction in the overall operation length). Furthermore, since the electromagnetic polarization solid adhesive used is a zero Volatile Organic Compound (VOC) material, there is no need to apply a surface modifier to the sole surface with a processing agent, eliminating steps that induce better adhesion through chemical reactions on the surface. This not only benefits the improvement of the working environment but also enhances the safety and health conditions for employees, contributing to sustainable development for both labor and management sides.

In conclusion, the adhesive bonding method for shoe making described in this invention undoubtedly presents an innovative structure that has not been previously disclosed in any publication, nor is there any product made by a similar method available on the market. Therefore, its novelty is unquestionable. Additionally, the unique features and functionalities of this invention are far beyond what is available in conventional practices, demonstrating its advanced nature. Thus, it meets the criteria for patent application according to the regulations concerning the application for invention patents, justifying the submission of a patent application in accordance with the law.

It should be clarified that the descriptions provided above represent the preferred embodiments of the invention. Changes or amendments made within the spirit and scope of this invention, as covered by the description and illustrations, without exceeding the intended functionality and effect, should still be considered within the scope of this invention and thus, deserve to be disclosed.

What is claimed is:

1. An adhesive bonding method for shoe making involving an adhesive bonding process between shoe vamps and soles, comprising the following continuous operations: applying a melted liquid electromagnetically polarized solid adhesive to a surface of the sole; then placing the vamp on the sole and then both are fixed with a fixture; subsequently, putting the sole, vamp, and fixture together into an electromagnetic polarization device for heating; through electromagnetic waves generated by the device, positive and negative electric fields change rapidly, pulling the charged particles on an electromagnetically polarized activator to migrate swiftly, eliminating crystallization caused by hydrogen bonds in an adhesive molecular structure to form a bonding effect between the vamp and the sole to make a shoe; upon removing the shoe, unreacted isocyanate functional groups at both ends of the adhesive molecular structure react with moisture in the air, returning to the original crystalline molecular structure, and forming hydrogen bond cross-linking with the molecules of an outsole and a midsole, achieving a tight and firm combination of the sole and vamp; the temperature at which the electromagnetically polarized solid adhesive becomes liquid is 40° C.-80° C.

2. The adhesive bonding method for the shoe making as claimed in claim 1, wherein the duration of action in the electromagnetic polarization device for the sole and vamp is approximately 10-100 seconds.

3. The adhesive bonding method for the shoe making as claimed in claim 1, wherein the electromagnetically polarized solid adhesive consists of components including prepolymer, diisocyanate hardener, tackifier, auxiliary agents, filler, electromagnetically polarized active agent, resistance adjuster, catalyst, and coupling agent.

* * * * *